United States Patent [19]

Kobayashi et al.

[11] 4,330,968

[45] May 25, 1982

[54] TWO-TANK HIGH WATER PRESSURE WET BLASTING MACHINE WITH SEPARATE SUPPLY RESERVOIR FOR ABRASIVE PARTICLES

[75] Inventors: Shigeharu Kobayashi, Yokohama; Toshiyuki Takagi; Chiaki Hayashi, both of Shizuoka, all of Japan

[73] Assignee: Fuji Seiki Machine Works, Ltd., Shizuoka, Japan

[21] Appl. No.: 146,541

[22] Filed: May 2, 1980

[51] Int. Cl.[3] ..... B24C 7/00

[52] U.S. Cl. ..... 51/425; 51/426; 51/436

[58] Field of Search ..... 51/320, 321, 421, 425, 51/426, 427, 436, 437, 439

[56] References Cited

U.S. PATENT DOCUMENTS

| | | | |
|---|---|---|---|
| 2,366,763 | 1/1945 | Wieland | 51/437 |
| 2,389,616 | 11/1945 | Franklin | 51/437 |
| 2,475,215 | 7/1949 | Barker | 51/436 X |
| 3,455,062 | 7/1969 | Eppler | 51/425 |
| 3,553,895 | 1/1971 | Power | 51/436 X |
| 3,994,097 | 11/1976 | Lamb | 51/436 X |

FOREIGN PATENT DOCUMENTS 48-89837 5/1973 Japan .

*Primary Examiner*—Nicholas P. Godici

*Attorney, Agent, or Firm*—Blanchard, Flynn, Thiel, Boutell & Tanis

[57] ABSTRACT

A wet blasting machine having a slurry reclaiming tank and a clear liquid tank, both located at the lower part of the blasting chamber. An abrasive particle reservoir is located adjacent the blasting chamber and above the reclaiming tank. The inside of the reservoir is separated by a perforated plate into an abrasive particle chamber and a liquid chamber. The lower part of the separating plate defines an outlet for the abrasive particles. A blasting gun is positioned inside the blasting chamber, and a high pressure pump supplies clear liquid to the gun. A slurry-inducing pipe passes through the outlet of the abrasive particle chamber and has one end thereof opening into the liquid chamber, and the other end thereof connected to the blasting gun. A slurry pump supplies the mixture in the reclaiming tank to a liquid-solid separating device wherein the separated liquid is sent to the clear liquid tank and the separated particles are sent to the abrasive particle chamber.

9 Claims, 7 Drawing Figures

TWO-TANK HIGH WATER PRESSURE WET BLASTING MACHINE WITH SEPARATE SUPPLY RESERVOIR FOR ABRASIVE PARTICLES

FIELD OF THE INVENTION

This invention relates to improvements for a high-water-pressure wet blasting machine with two tanks.

BACKGROUND OF THE INVENTION

The wet blasting machine works primarily by blasting a slurry using the force of compressed air. The slurry is sent to the blasting gun by a low-pressure slurry pump, and the slurry after blasting is separated into two parts, solid particles and liquid. An air compressor and a low-pressure slurry pump are indispensable equipment for this machine to operate. Accordingly, the size of the machine becomes large, and its price is expensive.

Applicant, in an attempt to eliminate such disadvantages, has offered a high-water-pressure wet blasting machine in which the clarified water in the clear water tank is sent to the blasting gun by a high-pressure pump and, by ejection of this high-pressure water, slurry in the reclaiming hopper is sucked and is blasted through the blasting gun with the high-pressure water. The blasted slurry is sent to a solid-liquid separator, where the separated solid particles are returned to the reclaiming hopper and other separated liquid is clarified in the clear tank. In this machine, the reclaiming hopper is located lower than the blasting gun, so that the vacuum force generated by the Venturi effect of the blasting gun is used to bring the slurry upwardly from the water level of the reclaiming hopper to the height of the blasting gun. The necessary suction force generated by the Venturi effect must consequently be of large magnitude in order to suck the slurry up from the reclaiming hopper to the gun, and hence the pressure of the clear water supplied to the gun as the ejecting medium needs to be high (such as at least 30 kg/cm$^2$, or more) so as to create a sufficiently strong suction or Venturi effect.

The present invention relates to improvements in the wet blasting machine so as to improve upon the known operation. More specifically, by use of a third tank or reservoir for abrasive particles positioned substantially at, or above, the elevation of the blasting gun, the water pressure can be substantially reduced while still maintaining the same effective cutting rate. The present invention also permits the successful use of ferrous particles as the blasting medium when water is used as the ejecting medium.

DETAILED DESCRIPTION

Figure 1:
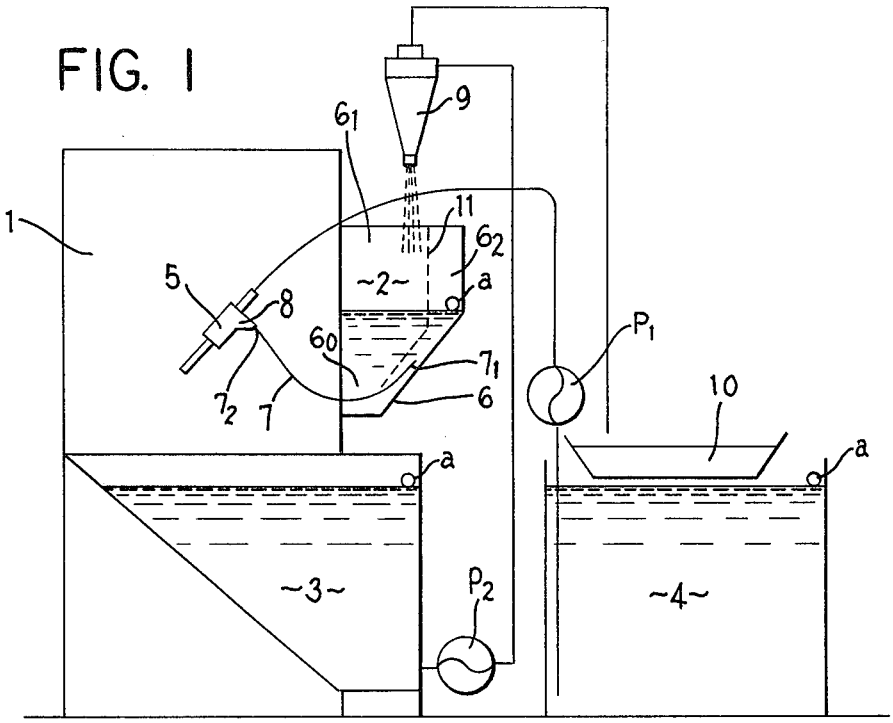
FIG. 1 is an elevational view of a first embodiment of the machine embodying the invention.

The constitution of the wet blasting machine is, by the example, shown in FIG. 1, which is one embodiment of the invention. This high-water-pressure wet blasting machine is provided with two tanks, namely a slurry reclaiming tank or hopper 3 and a clear liquid tank 4. Both tanks are located side-by-side at the lower part of the blasting chamber 1. The machine also includes an abrasive particle reservoir 2 located at the side wall of the blasting chamber 1 and above the reclaiming hopper 3. The inside of particle reservoir 2 is separated by a perforated plate 11 in two sections comprising an abrasive particle chamber $6_1$ and a liquid chamber $6_2$. The lower part of the separating plate 11 comprises an outlet $6_0$ for the abrasive particles at the lower part of the abrasive particle chamber $6_1$. A blasting gun 5 is positioned inside the blasting chamber 1. The clear liquid in tank 4 is supplied to the blasting gun 5 by the high pressure pump $P_1$. A slurry-inducing pipe 7 passes through the outlet $6_0$, with one end $7_1$ of pipe 7 opening into the liquid chamber $6_2$, and the other end $7_2$ of which is connected to the slurry inlet 8 of the blasting gun 5. In the machine, the mixture in the reclaiming hopper 3 is sent by the slurry pump $P_2$ to the liquid-solid separating device 9 such as a hydro-cyclone, wherein the separated liquid is sent to the clear water tank 4, passing through a filter 10, and the other separated solid particles (with some liquid) are sent to the abrasive particle chamber $6_1$ of the abrasive particle reservoir 2. In FIG. 1, designation "a" shows the location of the opening of an over-flow pipe for the tanks.

The machine embodying the invention has the constitution described above. The abrasive particle reservoir 2 is located higher than the abrasive reclaiming hopper 3, and is located at approximately the same height as the blasting gun 5. Thus, the difference in water level or elevation between one end $7_1$ of the slurry-inducing pipe 7 and the slurry inlet 8 of the blasting gun 5 is reduced to almost zero. Thus, the pressure of the liquid sent from the clear liquid tank 4 need not be very high, for example, water pressure of 20 kg/cm$^2$ is enough for the blasting gun to perform an efficient blasting operation.

As noted above, the abrasive particle reservoir 2 is separated into two sections by the perforated separation plate 11, i.e., the abrasive particle chamber $6_1$ and the liquid chamber $6_2$. The lower extended part of the separating plate 11 forms the outlet $6_0$ for the abrasive particles. The slurry-inducing pipe 7, which connects to the inlet 8 of the blasting gun 5, passes through the outlet part of abrasive particles and opens at its other end into the liquid chamber $6_2$. Due to the Venturi effect generated by ejection of the high pressure water in the blasting gun, liquid in the liquid chamber $6_2$ is at first sucked into the blasting gun, and then abrasive particles are led by the flow generated by the suction and are brought to the outlet port $6_0$ of the abrasive particles without forming a bridge thereover. Abrasive particles are thus sucked into chamber $6_2$ and into tube 7 and are smoothly and uniformly fed to the blasting gun.

Figure 2A:
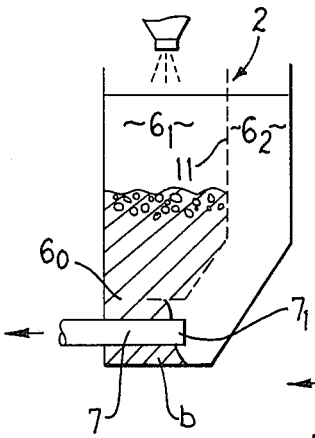
FIGS. 2A and 2B are enlarged elevational views of the bottom part of the abrasive particle reservoir.

As shown in FIG. 2A, the slurry-inducing pipe 7 is preferably positioned in parallel within an annular part or tube b which is formed by extending the lower part of the separating plate 11 horizontally, whereby the abrasive outlet $6_0$ is formed at the recess in this annular part b. One end of the slurry-inducing pipe $7_1$ passes through this annular part b and extends a small distance past the outlet port of the abrasive particles so as to open into the liquid chamber $6_2$.

Figure 2B:
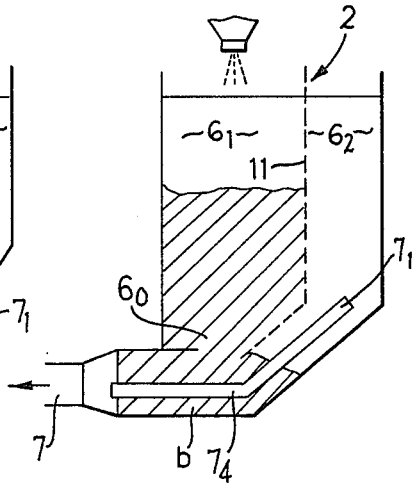

As shown in FIG. 2B, it is preferable that annular part b is formed at the lower part of the abrasive particle chamber $6_1$, and the outer end of this annular part b is gradually shrunk in diameter to form the primary slurry-inducing pipe 7. A secondary slurry-inducing pipe $7_4$, which is positioned inside the primary inducing pipe, has one end opening into the liquid chamber $6_2$ and the other end opening into the primary inducing pipe 7, thus forming a double annular form. The secondary pipe $7_4$ thus extends through the quantity of abrasive particles which collect within and below the outlet $6_0$.

When using the separate abrasive particle reservoir 2 according to the present invention, the use of the perforated separating plate 11 effectively maintains the abrasive particles within the chamber $6_1$, so that the other chamber $6_2$ thus contains predominantly liquid therein. The perforated plate 11, however, results in the water or liquid level in both chambers being the same. Further, since the lower part of this plate 11 functions effectively as a gate for providing only controlled or limited connection between the liquid and abrasive particle chambers, this thus permits the abrasive particles to sink to the bottom of the reservoir 2 and thus heap or build up around the inducing pipe 7, but at the same time this pipe extends through the build up of particles so that the inlet end $7_1$ projects into the liquid chamber $6_2$ by a small distance so as to thereby not be blocked by the particles. Thus, when pressurized water is supplied to the blasting gun so as to create a suction therein, this suction is transmitted through the pipe 7 so that rather clear liquid within the chamber $6_2$ is first drawn into the inlet end $7_1$ of the pipe 7. This creates a liquid flow within the reservoir 2, which flow results in entrainment of some of the abrasive particles so that, as the suction force becomes stronger, the flow and hence entrainment of particles within the reservoir becomes stronger, so that the slurry including the abrasive particles therein is thus uniformly sent to the blasting gun. In this way, a rather constant build up of abrasive particles remains in close proximity to the inlet end $7_1$ of the inducing pipe so as to permit a continuous and uniform supply of slurry and specifically abrasive particles through the pipe, while at the same time preventing a blockage of the inlet end of the pipe either during operation or during shutdown periods.

Figure 5:
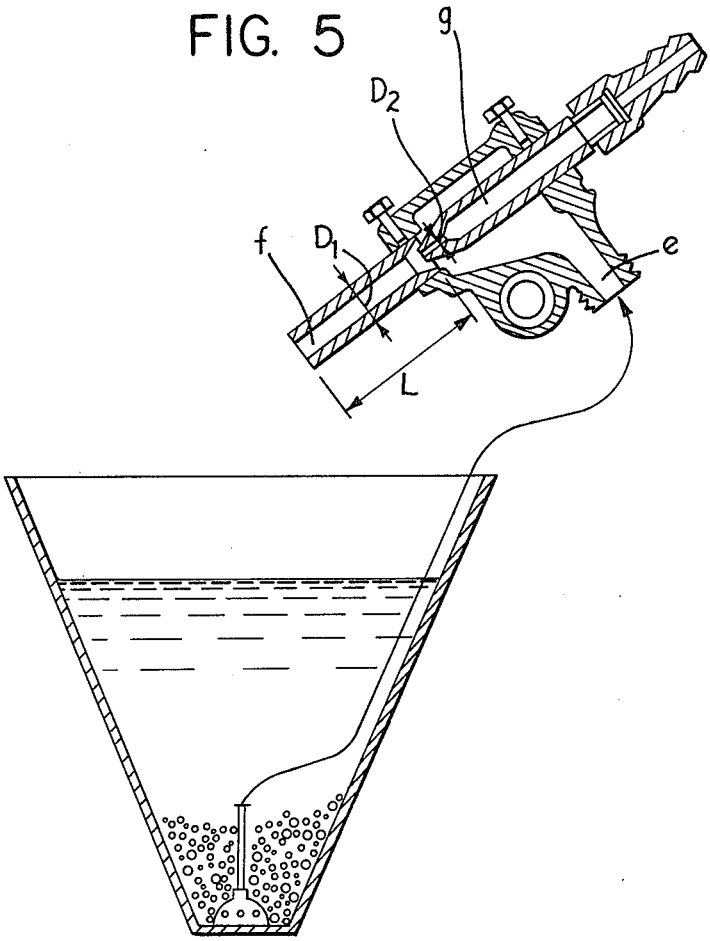
FIG. 5 is a sectional elevational view of an improved blasting gun which has a high stock removal rate when used with a known high-water-pressure blasting machine.

The range of water pressure in a conventional high pressure water blasting machine with two tanks is 10 to 50 kg/cm$^2$, when using the improved gun shown in FIG. 5. In this gun, the ratio of the inside diameter $D_1$ of the blasting nozzle f and the inside diameter $D_2$ of the jet orifice of the pressurized water is about 2, and the nozzle length L is sixfold its inside diameter $D_1$, thereby providing a cutting ratio per minute when blasting mild steel plate of 0.53 gram/minute. On the other hand, when the machine incorporates three tanks and is constructed according to the embodiment of the invention shown in FIGS. 1 and 2, the pressure range used in the machine is reduced to 5 to 30 kg/cm$^2$ while keeping the same cutting ratio as that of the conventional two-tank water pressure blasting machine.

Figure 3:
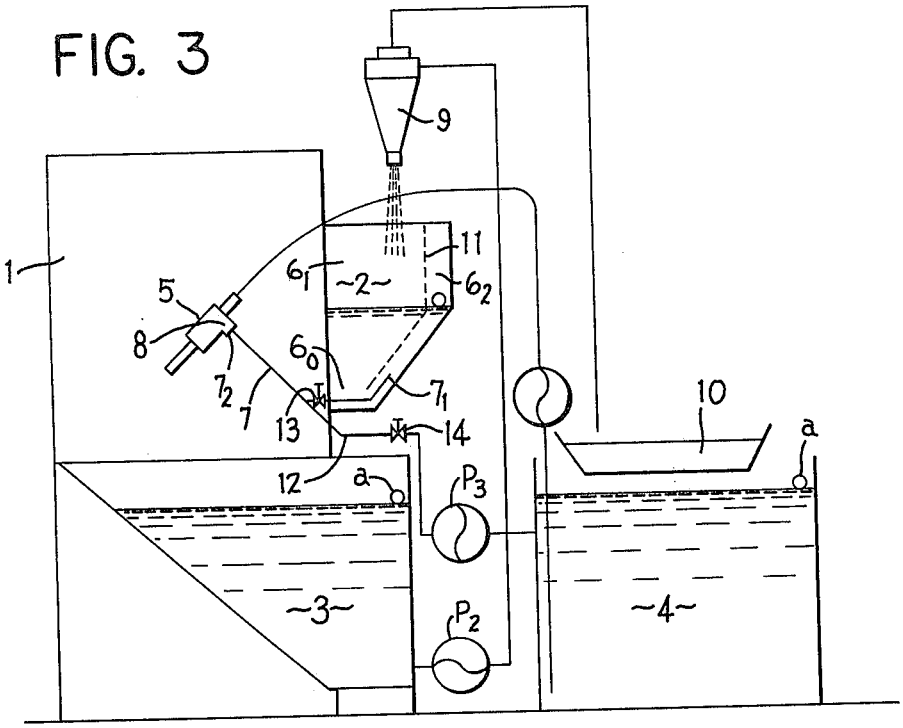
FIG. 3 is an elevational view of a second embodiment of the machine embodying the invention.

A second embodiment of the invention is illustrated, by way of example, in FIG. 3. In this modification, the slurry-inducing pipe 7 has a branch line 12 leading to the clear water tank 4 and is furnished with a pump $P_3$ in the middle of this branch line.

Figure 4:
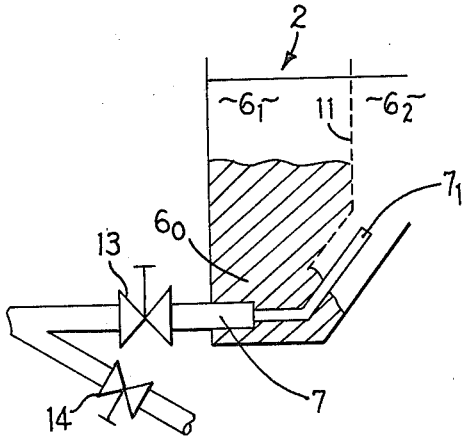
FIG. 4 is an enlarged elevational view of the bottom part of the abrasive particle reservoir shown in FIG. 3.

FIG. 4 is an enlarged drawing of the part of FIG. 3 at the bottom of the abrasive particle chamber $6_1$. The branch 12 and the slurry-inducing pipe 7 are provided with stop valves 14 and 13, respectively. After closing stop valve 13 and opening stop valve 14, clear liquid in the clear liquid tank 4 is sent to the blasting gun, passing through the slurry-inducing pipe 7. Thus, the inside of the slurry-inducing pipe 7 and the blasting gun 5 is washed and cleaned. The pressure of the pump $P_3$ is possibly 1 to 2 kg/cm$^2$ to perform cleaning of the line.

Figure 6:
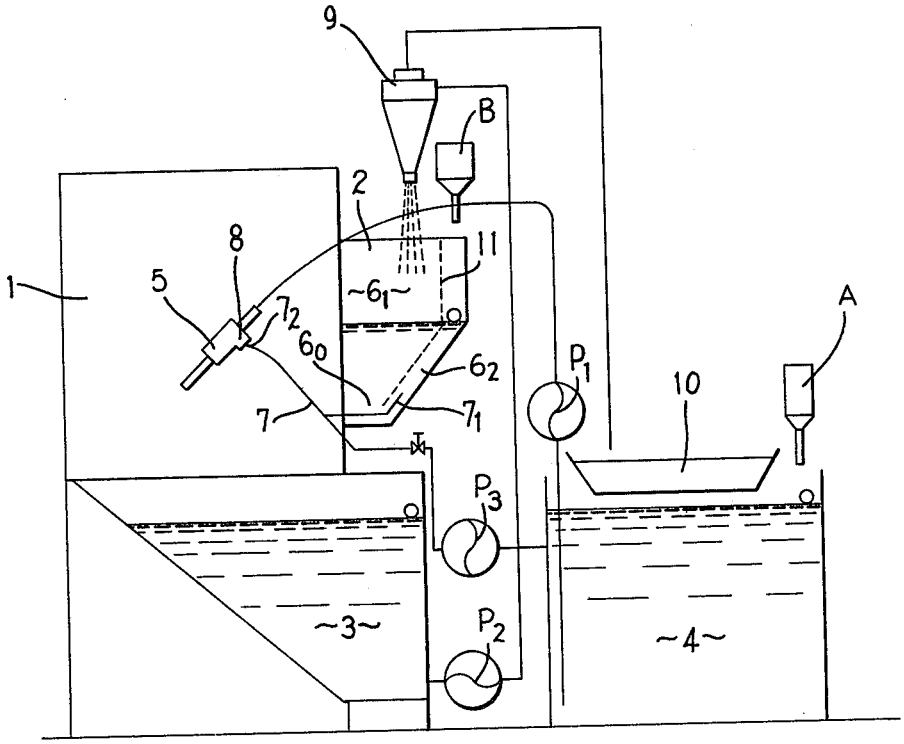
FIG. 6 is an elevational view of a third embodiment of the machine embodying the invention.

A third embodiment of the invention is illustrated by FIG. 6. This wet blasting machine is furnished with two tanks which are the slurry reclaiming hopper 3 and the clear liquid tank 4, both located at the lower part of the blasting chamber 1 side-by-side. The clear liquid tank has associated therewith a fixed-rate dripping device A for oxidization chemicals which may, or may not, include a cohesive agent. The reservoir 2 for ferrous abrasive particles has associated therewith a fixed-rate dripping device B for rust preventive chemicals which are deposited into the reservoir 2.

This machine embodying the invention as shown in FIG. 6 thus permits use of iron abrasive particles for blasting. Since the dripping device B deposits rust preventive chemicals into the reservoir 2, the surfaces of the iron or ferrous abrasive particles are coated with a rust-preventive film. The dripping device A, on the other hand, supplies oxidization chemicals to the clear liquid tank 4. By action of oxidization chemicals, ferrous ion or ferrous hydrate in the liquid in tank 4 is oxidized, and thus settles in the tank as ferric oxide. Thus, iron abrasive particles which are prevented from rusting by anti-rust chemicals on their surface are mixed with liquid from which iron oxide has been removed, and the mixture is sucked and blasted from the blasting gun by ejection of high pressure water sent by high pressure pump $P_1$.

Rust preventive chemicals, as used in the abrasive particle reservoir, are absorption-type high polymer chemicals such as etanol amin, or butyl benzol type. The oxide agent used in the clear liquid tank 4 is an oxidized agent, the main ingredient of which is ferrous iron or iron phosphate and which may or may not include a cohesive agent, thus removing solutions of ferrous iron by converting it to ferric iron-unsoluble oxide. Clear liquid is sent to the blasting gun by the high pressure pump.

In this invention, having the above-mentioned constitution and performance, iron particles which hitherto have not been used in the wet blasting method, can now be used as the blasting media. In the conventional wet blasting method, natural abrasives such as silica sand, zircon sand, quartz, and artificial abrasives such as aluminum oxide, or carbon silicate, are used as the blasting media. These abrasives are expensive. The iron abrasives are generally not expensive when compared with these other abrasives. The main reason why iron particles were not used in wet blasting, is that iron particles are attacked by water. The iron particles gradually convert to bi-valent iron ions from its surface. These ferrous ions combine with hydrate and make ferrous hydrate, which then converts to ferric hydrate due to the oxygen in water.

As regards known wet blasting methods which use compressed air as the expelling means for the abrasive particles, oxygen is utilized throughout the blasting process. Accordingly, generation of rust is accelerated when using iron particles. When water is sprayed or deposited on the surface of the cabinet wall, or piping, or other plumbing articles, ferrous oxide in the water droplets is oxidized and makes a thin film on the surface of these articles. This film grows gradually and becomes thick enough so that it is not easily removed. Moreover, small fractures of iron particles produced by the abrasion action of the abrasive particles during blasting, are included in the sprayed water. These small iron particles, if attached on the surface of the piping, inner wall or plumbing articles, stick together by the cohesive strength of ferric oxide, and also make an oxide film on the surface of these articles. Iron particles settled in the abrasive reclaiming hopper stick together by the cohesion tendency of ferric oxide in the reclaiming hopper. The iron abrasives increase in diameter and grow to a volume similar to the size of small beans.

With this known wet blasting machine and method, the following problems occur:

1. When the material used in making the wet blasting machine is mild steel plate, the surface of the machine becomes covered by an oxide film. As the iron oxide film is usually porous in nature, stain or rust attacks deeply into the mild steel plate.

2. Such oxide film develops on the surface of articles, and some of the film may peel off by impact of the machine during blasting. This may cause clogging in the piping. Especially, when clogging happens within the nozzle and/or jet of the blasting gun, the performance of the blasting gun is reduced.

3. The oxide film grows at the junctions in the piping. The layer of oxide is very hard to remove, and couplings can not be released, since nuts or threads can not be turned by usual means.

These problems thus hinder the performance of known wet blasting machines. However, these defects caused by use of iron particles as the blasting media, are eliminated by this invention.

The reason that the fixed-rate dripping device B for rust preventive chemicals is furnished on the abrasive particle reservoir 2 to prevent rust from growing, and the fixed-rate dripping device A for oxidization chemicals is furnished on the clear liquid tank to convert ferrous oxide to insoluble ferric oxide, is because abrasive particles have always been moving, flowing, and giving impact to articles to be blasted by being expelled by pressurized water, so that a rust preventive effect can not be expected by conventional rust prevention such as addition of rust preventive chemicals into a working liquid.

In the present invention, the improved design of the blasting gun as shown in FIG. 5 permits a more desirable blasting operation to be carried out when utilizing a wet blasting method. More specifically, in the blasting machine, the abrasive particles should be accelerated to at least a minimum speed sufficient to abrade the surface of the workpiece. However, it is difficult to accelerate all particles evenly to such a high speed, especially when the blasting machine utilizes liquid (such as water) under pressure as the prime driving force. This is because the surface tension of the liquid acts as a restraining force. That is, a surface tension layer exists near the surface of the liquid jet stream, and the solid abrasive particles can not be evenly mixed into the liquid jet stream when the blasting gun follows conventional design criteria. Accordingly, it has been discovered that the design of the blasting gun shown in FIG. 5 has been very effective due to the inclusion of the long nozzle. Specifically, in this blasting gun, the slurry which is drawn by the Venturi effect into the blasting gun is initially mixed with the water jet stream in the tapered conical guide portion which is located at the inlet or upstream end of the nozzle f, this guide portion being disposed in surrounding relationship to the small jet orifice of diameter $D_2$. The slurry, mixed with the driving pressurized water, is then forced through the elongated nozzle f which thus provides sufficient time to permit the particles to be properly accelerated and substantially uniformly diffused throughout the water jet stream so that, when discharged from the nozzle, effective blasting of the surface of a workpiece can be accomplished.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a wet blasting machine having a blasting chamber and also having a slurry reclaiming tank and a clear liquid tank both located at the lower part of the blasting chamber, the improvement comprising:

an abrasive particle reservoir located at the side wall of the blasting chamber and above the reclaiming tank, the inside of said reservoir being separated by a perforated plate into an abrasive particle chamber and a liquid chamber, the lower part of said separating plate defining an outlet for the abrasive particles at the lower part of the abrasive particle chamber;

a blasting gun positioned inside the blasting chamber;

pipe means, including high pressure pump means, for supplying clear liquid from the clear liquid tank to the blasting gun;

a slurry-inducing pipe, one end of which opens into the liquid chamber after passing through the abrasive particle chamber at its outlet, and the other end of which is connected to the slurry inlet of the blasting gun;

a branch pipe connected to the middle of the slurry-inducing pipe and leading to the clear liquid tank with a medium pressure pump associated therewith; and means, including a slurry pump, for supplying the mixture in the reclaiming tank to a liquid-solid separating device wherein the separated liquid is sent to the clear liquid tank and the other separated solid particles are sent to the abrasive particle chamber of the abrasive particle reservoir.

2. In a wet blasting machine having a blasting chamber and also having a slurry reclaiming tank and a clear liquid tank, the reclaiming tank being located at the lower part of the blasting chamber, the improvement comprising:

a fixed-rate dripping device for supplying oxidization chemicals into said clear liquid tank;

a ferrous abrasive particle reservoir separated into an abrasive particle chamber and a liquid chamber, and a fixedrate dripping device for supplying rust preventive chemicals to said reservoir;

a blasting gun positioned inside the blasting chamber;

a high pressure pump for supplying the clear liquid in said clear liquid tank to the blasting gun;

a slurry-inducing pipe, one end of which opens into the liquid chamber, and the other end of which is connected to the slurry inlet of the blasting gun;

a liquid-solid separating device; and a slurry pump for supplying the mixture in the reclaiming tank to said liquid-solid separating device from which the separated liquid is sent to the clear liquid tank and the separated solid particles are sent to the abrasive particle chamber of said reservoir.

3. In a wet blasting machine having means defining therein a blasting chamber, a blasting gun positioned within said chamber for discharging a slurry of liquid and abrasive particles against a workpiece, a reclaiming tank located below the blasting chamber for collecting therein the slurry, a clear liquid tank containing therein a quantity of clear liquid, means including a high pressure pump for supplying clear liquid to said blasting gun to create a jet stream which functions as the driving force for ejecting abrasive particles from said gun, and means for supplying a slurry containing abrasive particles to said gun, said slurry being sucked into said gun by a Venturi effect, the improvement comprising:

reservoir means for holding therein abrasive particles, said reservoir means being mounted at an elevation substantially above that of said reclaiming tank and at an elevation substantially at or above the elevation of the blasting gun;

said reservoir means having divider means therein for dividing the interior of same into an abrasive particle chamber and a liquid chamber, said divider means having opening means associated therewith for enabling the liquid level in both chambers to be the same, and said divider means adjacent the lower end of said reservoir means cooperating with the reservoir means to define a discharge opening or gate for permitting abrasive particles to collect adjacent and in communication with the lower portion of said liquid chamber;

said supplying means including suction pipe means extending between said blasting gun and said liquid chamber for permitting slurry to be withdrawn from said reservoir means and supplied to said blasting gun, said suction pipe means having one end thereof connected to said blasting gun and the other end thereof opening directly into said liquid chamber at a location spaced from the collection of abrasive particles in the bottom of said reservoir means for preventing blockage of said pipe means by said abrasive particles, said other end of said suction pipe means being disposed at an elevation approximately at the elevation of said blasting gun; and said supplying means also including a liquid-solid separating device and means for supplying the slurry from said reclaiming tank to said separating device, the clear liquid as separated in said device being returned to the clear liquid tank, and the solid particles as separated by said device being supplied to said abrasive particle chamber of said reservoir means.

4. A machine according to claim 3, wherein said suction pipe means comprises a single elongated pipe having said other end thereof positioned in open communication with said liquid chamber closely adjacent but spaced from the collection of abrasive particles in the bottom of said reservoir means, whereby when pressurized clear liquid is supplied from the clear liquid tank to the blasting gun it creates a suction through said pipe so that clear liquid is first drawn into said other end of said pipe and this then creates a liquid flow within said reservoir means which results in entrainment of some of the abrasive particles from the collection within the bottom of said reservoir means, said other end of said pipe remaining free of said collection of particles so as to prevent blockage of said pipe.

5. A machine according to claim 3, wherein said suction pipe means includes a first elongated pipe section having a discharge end thereof connected to said blasting gun and the inlet end thereof connected to the lower end of said reservoir means, said suction pipe means also including a second elongated pipe section having one end thereof opening directly into said liquid chamber at a location spaced from the collection of abrasive particles, said second pipe section having the other end thereof projecting coaxially into the inlet end of said first pipe section so that said other end of said second pipe section is positioned close to but spaced from said collection of abrasive particles.

6. A machine according to claim 3, including a branch pipe extending from the clear water tank to the suction pipe means at a location intermediate the ends thereof, a medium pressure pump associated with said branch pipe for permitting liquid to be supplied therethrough from said liquid tank to said blasting gun, and valve means associated with the branch pipe for selectively opening and closing same.

7. A machine according to claim 3, wherein said suction pipe means adjacent said other end thereof includes a pipe section which projects into said reservoir means and through the collection of abrasive particles within the bottom of said reservoir means so that said other end of said suction pipe means communicates directly with the liquid in said liquid chamber.

8. A machine according to claim 3, including overflow means associated with said reservoir means for maintaining the liquid level in said reservoir means approximately at the elevation of said blasting gun.

9. A machine according to claim 3, wherein said reservoir means is mounted on the wall of the blasting chamber in sidewardly spaced relationship from said blasting gun, said divider means including a perforated wall positioned within the interior of said reservoir means and projecting approximately vertically for dividing the reservoir means into said abrasive particle and liquid chambers, and said separating device being positioned directly above said reservoir means for discharging the separated abrasive particles along with some liquid directly into the abrasive particle chamber of said reservoir means, said reservoir means maintaining the maximum liquid level therein approximately at the elevation of said blasting gun.

* * * * *